United States Patent [19]

Kenny et al.

[11] 4,435,185

[45] Mar. 6, 1984

[54] FURNACE FUEL

[75] Inventors: Thomas C. Kenny, Syosset; John P. Plunkett, Smithtown, both of N.Y.

[73] Assignee: Horizon Chemical, Inc., Freeport, N.Y.

[21] Appl. No.: 81,017

[22] Filed: Oct. 1, 1979

[51] Int. Cl.[3] ..... C10L 1/22

[52] U.S. Cl. ..... 44/68; 44/57; 44/74; 44/75

[58] Field of Search ..... 44/74, 67, 68

[56] References Cited

U.S. PATENT DOCUMENTS

| | | | |
|---|---|---|---|
| 1,423,050 | 7/1922 | Tunison | 44/74 |
| 2,591,503 | 4/1952 | Bottoms | 44/68 |
| 2,926,184 | 2/1960 | Irish et al. | 44/68 |
| 3,157,682 | 11/1964 | Ramsden | 44/68 |
| 4,370,147 | 1/1983 | Kenny et al. | 46/68 |

OTHER PUBLICATIONS

Hengstebeck, *Petroleum Processing: Principles and Applications,* (New York, McGraw-Hill Book Company, Inc., 1959), p. 8.

*Primary Examiner*—Charles F. Warren
*Assistant Examiner*—Y. Harris-Smith
*Attorney, Agent, or Firm*—Scully, Scott, Murphy & Presser

[57] ABSTRACT

A significant improvement in the combustion properties of liquid hydrocarbon furnace fuel, perceived as a marked reduction in the rate and quantity of tarry, cokelike deposits formed on combustion of the fuel in conventional burner equipment, is obtained by adding to said fuel from about $1.0\times10^{-6}$ to about $1.0\times10^{-3}$ parts by weight of at least one isomer of dinitrotoluene. Optionally, combustion deposit formation can be further inhibited by the addition of at least one metal acetylacetonate to furnace fuel containing dinitrotoluene in the aforesaid amount.

16 Claims, No Drawings

FURNACE FUEL

BACKGROUND OF THE INVENTION

1. Field of the Invention

The present invention relates to liquid fuels for use in furnaces and, more particularly, to such fuels containing an additive ingredient which significantly improves their combustion efficiency and reduces their consumption.

2. Description of the Prior Art

With the accelerating rate of consumption of liquid hydrocarbon fuels derived from economically recoverable petroleum deposits, much emphasis has been placed as of late on conserving such fuels through improved design of equipment utilizing them and/or improving the combustion characteristics of the fuels with a view to exploiting their potential energy to a still greater degree. Furnace fuels for space heating and power generation account for a considerable portion of liquid hydrocarbon fuels consumed by the industrial nations of the world. Many of these fuels, especially those of the heavier types, burn only incompletely forming tarry, cokelike deposits which collect on the internal parts of burners. The formation of such deposits not only results in a significant loss of energy-producing material but requires their periodic removal, the frequency of which is proportionate to the rate of accumulation of the deposits. In utility and industrial power plants, the frequency and duration of furnace downtime occasioned by the excessive accumulation of combustion deposits in the fuel burner equipment can be directly translated into higher costs for all energy users.

SUMMARY OF THE INVENTION

In accordance with the present invention, a liquid hydrocarbon furnace fuel having significantly improved combustion characteristics is provided by the addition to said fuel of from about $1.0\times10^{-6}$ to about $1.0\times10^{-3}$ parts by weight thereof of at least one isomer of dinitrotoluene. The presence of dinitrotoluene in furance fuel in accordance with this invention has been found to exert a catalyst-like effect upon combustion of the fuel such that in known and conventional burner equipment, fuel combustion takes place with very little of the formation of tarry and cokelike deposits associated with the furnace fuels heretofore in use.

It is an additional feature of the invention herein to further enhance the reduction combustion deposit formation by further including in the furnace fuel at least one metal acetylacetonate.

DESCRIPTION OF THE PREFERRED EMBODIMENTS

The combustion characteristics of any of the known and conventional liquid furance fuels can be significantly improved by the addition of dinitrotoluene in accordance with this invention. Table I below sets forth some average physical and chemical properties of furnace fuels in accordance with U.S. government specification, Fuel Oil, Burner, VV-F-815.

TABLE I

| Grade of fuel oil | | Flash | Pour | Water and Sediment, | Carbon Residue on 10% | Ash | Distillation temperatures, °F. | | |
|---|---|---|---|---|---|---|---|---|---|
| Grade No. | Description | point, °F. | point, °F. | % Max | residuum, % Max | % Max | 10% point Max | 90% point Max | End point Max |
| 2 | Distillate oil for general purpose domestic heating for use in burners not requiring No. 1 | 100 or legal | 5 | 0.10 | 0.33 | ... | ... | 675 | ... |
| 4 | Oil for burner installations not equipped with preheating facilities | 130 or legal | 20 | 0.50 | ... | 0.10 | ... | ... | ... |
| 5 | Residual-type oil for burner installations equipped with preheating facilities | 130 or legal | ... | 1.00 | ... | 0.10 | ... | ... | ... |
| 6 | Oil for use in burners equipped with preheaters permitting a high-viscosity fuel | 150 or legal | ... | 2.00 | ... | ... | ... | ... | ... |

| Grade of fuel oil | | Viscosity | | | | | | | | Gravity |
|---|---|---|---|---|---|---|---|---|---|---|
| | | Saybolt | | | | Kinematic centistokes | | | | |
| | | Universal at 100° F. | | Furol at 122° F. | | At 100° F. | | At 122° F. | | °API |
| Grade No. | Description | Max | Min | Max | Min | Max | Min | Max | Min | Min |
| 2 | Distillate oil for general purpose domestic heating for use in burners not requiring No. 1 | 40 | ... | ... | ... | 4.3 | ... | ... | ... | 26 |

TABLE I-continued

| | | | | | | | | | |
|---|---|---|---|---|---|---|---|---|---|
| 4 | Oil for burner installations not equipped with preheating facilities | 125 | 45 | ... | ... | 26.4 | 5.8 | | |
| 5 | Residual-type oil for burner installations equipped with preheating facilities | ... | 150 | 40 | ... | ... | 32.1 | 81 | |
| 6 | Oil for use in burners equipped with preheaters permitting a high-viscosity fuel | ... | ... | 300 | 45 | ... | ... | 638 | 92 |

Any of the dinitrotoluene isomers set forth in Table II below can be used herein, singly or in admixture:

TABLE II

| dinitrotoluene isomer | melting point °C. |
|---|---|
| 2,4-dinitrotoluene | 71 |
| 2,3-dinitrotoluene | 63 |
| 2,5-dinitrotoluene | 48 |
| 2,6-dinitrotoluene | 66 |
| 3,4-dinitrotoluene | 59 |
| 3,5-dinitrotoluene | 92 |

For the sake of economy and convenience, it is preferred to employ the most commonly available isomer, 2,4-dinitrotoluene, which is commerce, is frequently supplied in admixture with a minor amount of 2,6-dinitrotoluene, the latter occurring in the manufacture of the former. In the present invention, a commercially available 80:20 weight mixture of the 2,4 and 2,6 isomers which melts at approximately 56° C. has been found to provide entirely acceptable results.

By themselves, none of the foregoing dinitrotoluene isomers are soluble in furnace fuel and they must therefore be incorporated into the fuel with the aid of a mutual solvent. The choice of mutual solvent is not a critical requirement of the present invention, it only being necessary that the solvent effect the complete dissolution of the dinitrotoluene at its level of concentration in a particular furnace fuel medium. Whether a particular substance is suitable for use as a mutual solvent herein can be readily determined employing standard techniques, i.e., solubility testing. Among the mutual solvents which can be advantageously used for this purpose, alone or in admixture, are dimethylformamide, halogenated hydrocarbons such as ortho-dichlorobenzene, trichloropropane and methylene chloride, cyclic ethers such as tetrahydrofuran and dioxolane, tricresyl phosphate, and the like. In general, the minimum amount of mutual solvent which results in complete dissolution of the selected isomer or isomer mixture in a given furnace fuel is preferred. Concentrations of isomer in the foregoing solvents ranging from about 5 to about 25 weight percent isomer are usually suitable.

An amount of dinitrotolune isomer/mutual solvent solution is added to the furnace fuel to provide a final concentration of isomer in the fuel of from about $1.0\times10^{-6}$ to about $1.0\times10^{-3}$ parts by weight and preferably from about $1.5\times10^{-6}$ to about $1.0\times10^{-5}$ parts by weight. At levels significantly below $1.0\times10^{-6}$ parts by weight of furnace fuel, the dinitrotoluene isomer will usually be present in the fuel in too small an amount to provide a noticeably improved effect on combustion performance. While amounts of dinitrotoluene in excess of $1.0\times10^{-3}$ parts by weight of fuel are usually effective, they confer no particular advantage over the lesser concentrations and considerations of economy militate against their use.

If desired, the dinitrotoluene/mutual solvent solution can be introduced into a small quantity of furnace fuel to provide an additive concentrate and this concentrate can thereafter be combined with a larger quantity of furnace fuel to provide the fuel of this invention.

By way of example, a concentrate of dinitrotoluene/mutual solvent solution in no. 2 heating oil can be prepared as follows.

| Component | Amount (weight ounces) |
|---|---|
| 80:20 weight mixture of 2,4-dinitrotoluene and 2,6-dinitrotoluene | 48 |
| dimethylformamide | 64 |
| ortho-dichlorobenzene | 64 |
| methylene chloride | 64 |
| tricresyl phosphate | 8 |
| no. 2 heating oil | 53.3 gallons |
| | 55 gallons (approx.) |

The above formulation can be admixed with liquid hydrocarbon furnace fuel at a level of from about 1 gallon additive to about 5,000 gallons fuel, and preferably, from about 1 gallon additive to about 4,000 gallons fuel.

In accordance with a further embodiment of the present invention, the combustion characteristics of a furnace fuel containing from about $1.0\times10^{-6}$ to about $1.0\times10^{-3}$ parts by weight of at least one isomer of dinitrotoluene is further improved by adding to said fuel, a combustion deposit inhibiting amount of at least one metal acetylacetonate. The useful metal acetylacetonates are in themselves well known compounds (viz. U.S. Pat. No. 2,086,775 (1936)) and are preferably selected from among the metal derivatives of the beta diketones. The metal moieties of such compounds can be advantageously selected from the group consisting of cobalt, nickel, manganese, iron, copper, uranium, molybdenum, vanadium, zirconium, beryllium, platinum, palladium, thorium, chromium, aluminum and the rare earth metals. Beta diketones useful in the preparation of the metal acetyl acetonates can be represented by the structural formula:

$R_1—CO—CHR_2—COR_3$ wherein $R_1$ and $R_3$ are hydrocarbon radicals which may carry halogen atoms as substituents, and $R_2$ is a hydrocarbon radical or a hydrogen atom. Specific beta diketones include acetylacetone, which is preferred, benzoylacetone and their alkyl aralkyl or aryl homologs. Useful metal acetylacetonates which can be used herein with good results include, singly or in admixture: nickel propionylacetonate, cobaltous propionylacetonate, cobaltic acetylacetonate, ferric acetylacetonate, cerous propionylacetonate, thorium acetylacetonate, zirconium acetylacetonate, chromic acetylacetonate, aluminum acetylacetonate, and the like. The metal acetylacetonates herein are generally quite effective when employed within the same ranges of concentration as the dinitrotoluene. It is preferred to incorporate from about $5.0\times10^{-6}$ to about $1.0\times10^{-5}$ parts by weight of metal acetylacetonate part by weight of fuel. If soluble in furnace fuel, the metal acetylacetonate can be incorporated directly therein but more usually, the metal acetylacetonate will be dissolved in one or a mixture of mutual solvents, together with the dinitrotoluene isomer, optionally with one or more detergents, and the resulting solution will be mixed with a minor quantity of base fuel to form an additive concentrate just as in the case of dinitrotoluene alone, supra.

In accordance with this invention, the following additive formulation, employed at a level of 1 gallon per 4,000 gallons of no. 2 heating oil can be employed with good results.

| Component | Amount (weight ounces) |
|---|---|
| ferric acetylacetonate | 30 |
| zirconium acetylacetonate | 4 |
| aluminum acetylacetonate | 4 |
| cobaltic acetylacetonate | 4 |
| chromic acetylacetonate | 4 |
| ortho-dichlorobenzene | 56 |
| dimethylformamide | 56 |
| dimethylsulfoxide | 7 |
| toluene | 56 |
| butyl cellosolve | 56 |
| methylene chloride | 128 |
| 80:20 mixture of 2,4-dinitrotoluene and 2,6-dinitrotoluene | 48 |
| tricresyl phosphate | 8 |
| Witconate 1840 (sulfonate fatty acid of Witco Chemical Corp.) | 2 |
| triethylamine | 7 |
| Class 2 diesel oil | 51 gallons |
| | 55 gallons (approx.) |

What is claimed is:

1. A liquid hydrocarbon furnace fuel having improved combustion properties by the addition thereto as a combustion catalyst of from about $1.0\times10^{-6}$ to about $1.0\times10^{-3}$ parts by weight of at least one isomer of dinitrotoluene.

2. The furnace fuel of claim 1 containing from about $1.5\times10^{-6}$ to about $1.0\times10^{-5}$ parts by weight of at least one isomer of dinitrotoluene.

3. The furnace fuel of claim 1 or 2 containg 2,4-dinitrotoluene.

4. The furnace fuel of claim 3 wherein the 2,4-dinitrotoluene is in admixture with a minor amount of 2,6-dinitrotoluene.

5. The furnace fuel of claim 1 containing a combustion deposit inhibiting amount of at least one metal acetylacetonate.

6. The furnace fuel of claim 5 containing the metal acetylacetonate in an amount of from about $1.5\times10^{-6}$ to about $1.0\times10^{-3}$ parts by weight per part by weight of fuel.

7. The furnace fuel of claim 6 containing the metal acetylacetonate in an amount of from about $1.5\times10^{-6}$ to about $1.0\times10^{-5}$ parts by weight per part by weight of fuel.

8. The fuel of claim 5 wherein the metal acetylacetonate is selected from the group consisting of nickel propionylacetonate, cobaltous propionylacetonate, cobaltic acetylacetonate, ferric acetylacetonate, cerous propionylacetonate, thorium acetylacetonate, zirconium acetylacetonate, chromic acetylacetonate and aluminum acetylacetonate.

9. A method for operating a furnace which comprises adding to the liquid hydrocarbon fuel employed in the furnace, from about $1.0\times10^{-6}$ to about $1.0\times10^{-3}$ parts by weight of at least one isomer of dinitrotoluene as a combustion catalyst for said fuel.

10. The method of claim 9 wherein the liquid hydrocarbon fuel contains from about $1.5\times10^{-6}$ to about $1.0\times10^{-5}$ part by weight of at least one isomer of dinitrotoluene.

11. The method of claim 10 wherein the liquid hydrocarbon fuel contains 2,4-dinitrotoluene.

12. The method of claim 11 wherein the 2,4-dinitrotoluene is in admixture with a minor amount of 2,6-dinitrotoluene.

13. The method of claim 9 wherein the liquid hydrocarbon fuel contains a combustion deposit inhibiting amount of at least one metal acetylacetonate.

14. The method of claim 13 wherein the metal acetylacetonate is present in the fuel in an amount of from about $1.0\times10^{-6}$ to about $1.0\times10^{-3}$ parts by weight per part by weight of fuel.

15. The method of claim 14 wherein the metal acetylacetonate is present in the fuel in an amount of from about $1.5\times10^{-6}$ to about $1.0\times10^{-5}$ parts by weight per part by weight of fuel.

16. The fuel of claim 13 wherein the metal acetylacetonate is selected from the group consisting of nickel propionylacetonate, cobaltous propionylacetonate, cobaltic acetylacetonate, ferric acetylacetonate, cerous propionylacetonate, thorium acetylacetonate, zirconium acetylacetonate, chromic acetylacetonate and aluminum acetylacetonate.

* * * * *